United States Patent [19]

Alvensleben et al.

[11] 4,223,633

[45] Sep. 23, 1980

[54] COATING APPLICATOR

[75] Inventors: Eric Alvensleben, Seattle, Wash.; Jay R. Ryan, Santa Paula, Calif.; Wayne C. Gaughran, Seattle, Wash.

[73] Assignee: Weyerhaeuser Company, Tacoma, Wash.

[21] Appl. No.: 16,639

[22] Filed: Mar. 1, 1979

[51] Int. Cl.[2] ..... B05C 1/00; B05C 1/06

[52] U.S. Cl. ..... 118/203; 118/249; 118/258; 118/259; 118/410

[58] Field of Search ..... 118/259, 203, 205, 206, 118/255, 249, 258, 410

[56] References Cited

U.S. PATENT DOCUMENTS

| | | | |
|---|---|---|---|
| 3,518,142 | 6/1970 | Dooley | 156/205 |
| 3,688,736 | 9/1972 | Beck et al. | 118/221 |
| 3,789,795 | 2/1974 | Brandenburg | 118/262 |
| 3,972,763 | 8/1976 | Wolvin et al. | 156/210 |

FOREIGN PATENT DOCUMENTS 548505 11/1957 Canada .

*Primary Examiner*—Bernard D. Pianalto

[57] ABSTRACT

This invention is an improved applicator for coatings. It is particularly useful for applying hot-melt adhesives in the manufacture of corrugated board. The applicator consists of an apertured manifold from which adhesive flows in parallel ribbons onto a transfer roll. This, in turn, prints it on the tips of the flutes at the single facer or double backer. The manifold is center fed and is equipped with motor-driven, axially adjustable pistons to adjust the width of adhesive spread to the width of surface being coated or bonded. An air purge system operating from within the pistons effectively removes any residual material from the orifices when the pistons are advanced toward the center of the manifold. This prevents plugging from adhesives setting up in the unused orifices. The purge system can also be used to clear orifices that become plugged during operation or to completely remove all adhesive from the manifold.

19 Claims, 11 Drawing Figures

Fig. 1
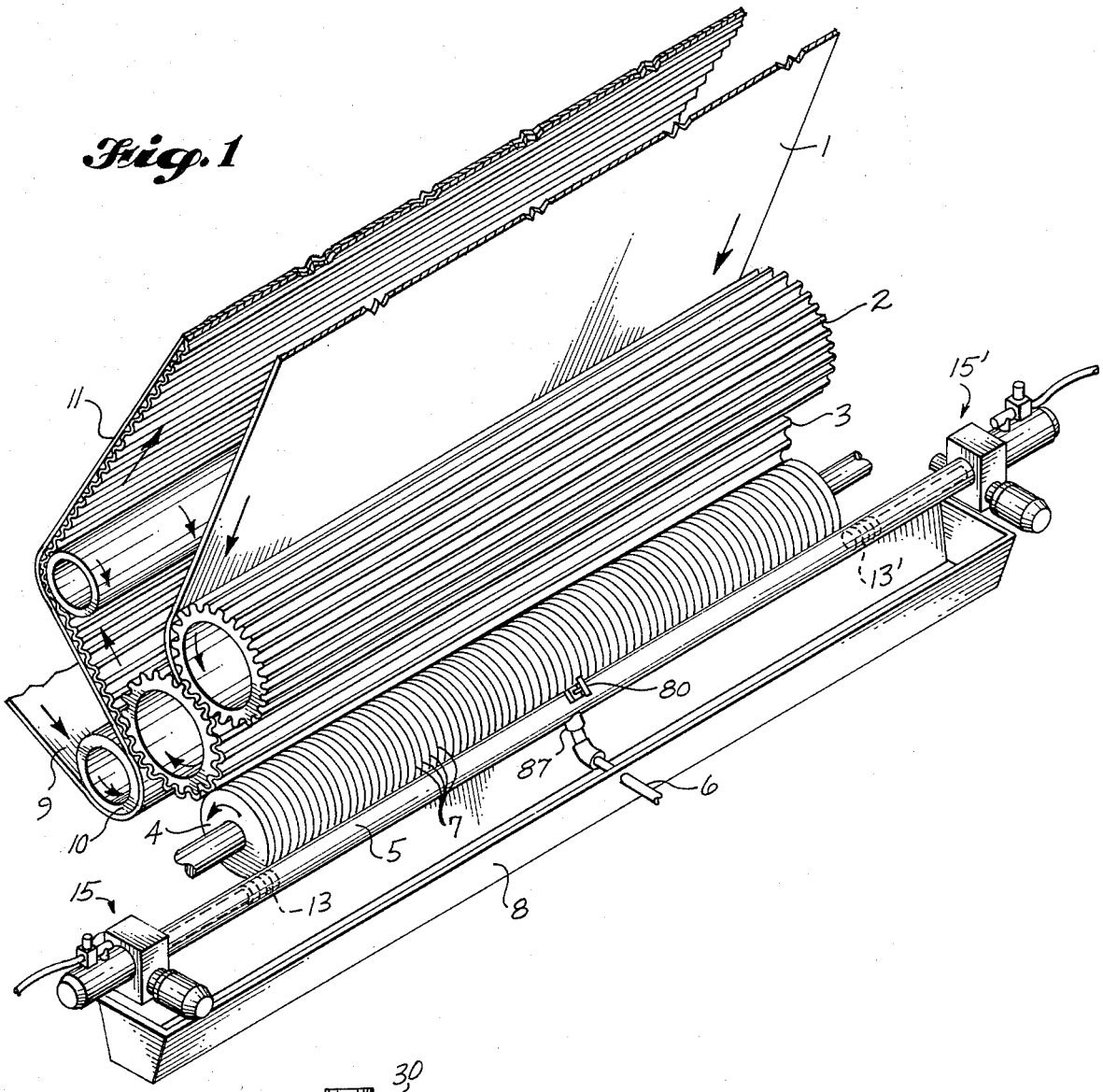
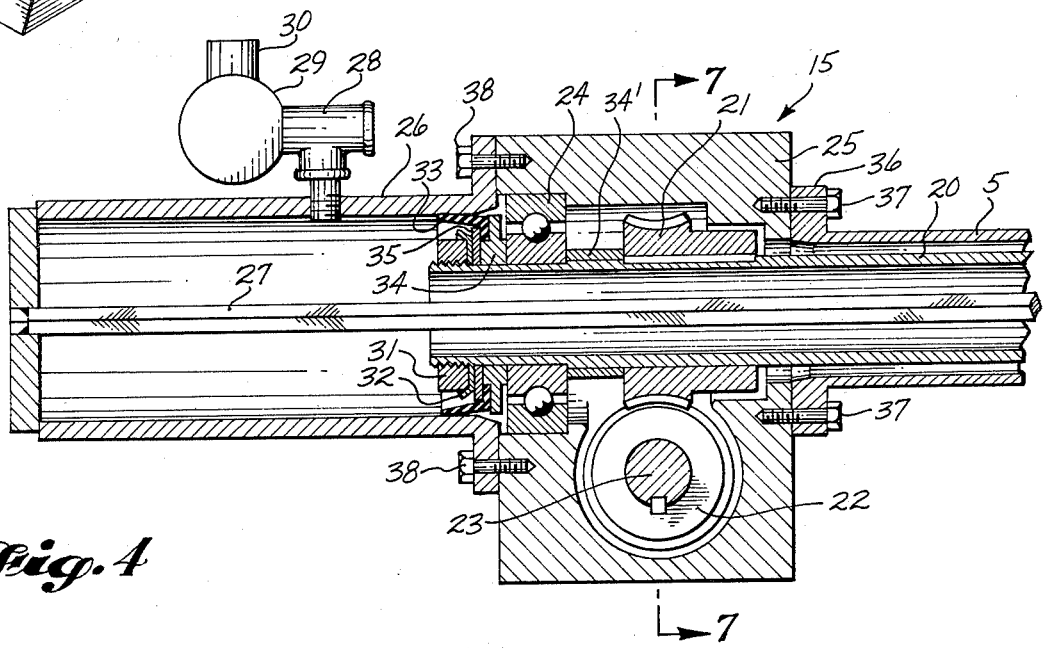
Fig. 4

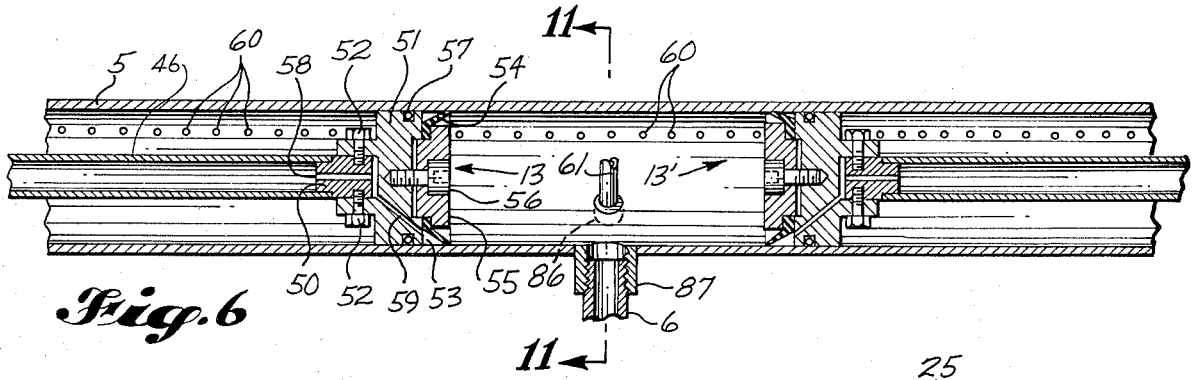
Fig. 6
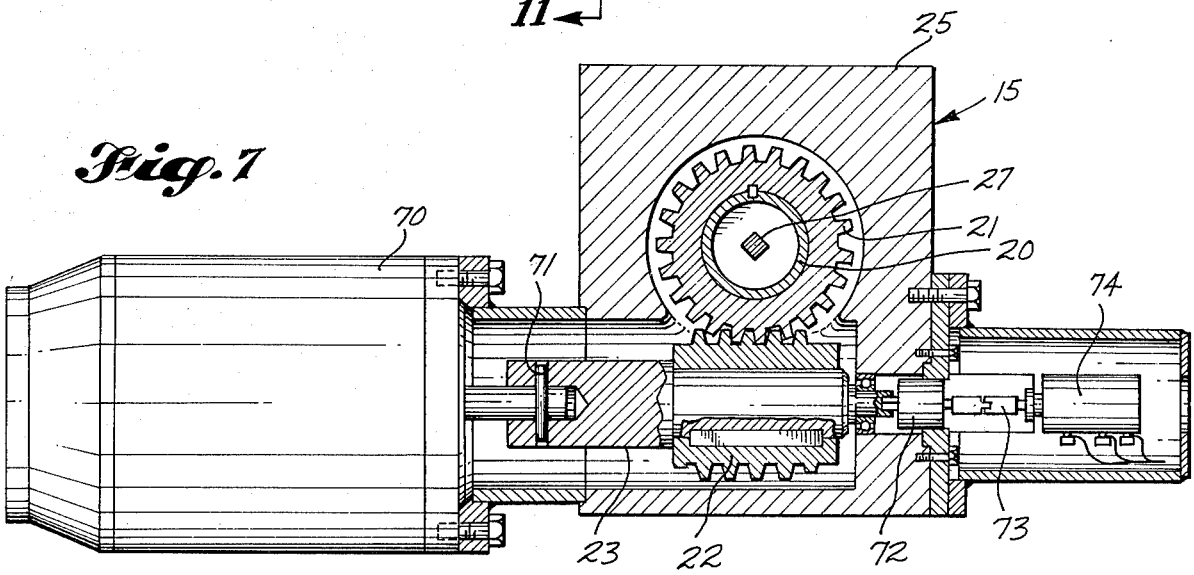
Fig. 7
Fig. 8
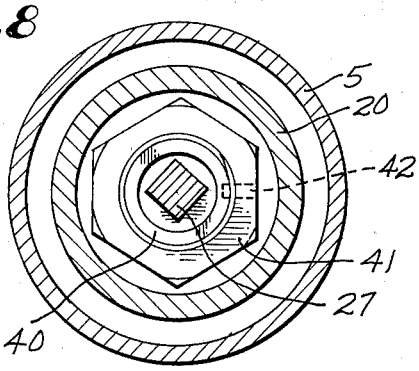
Fig. 9
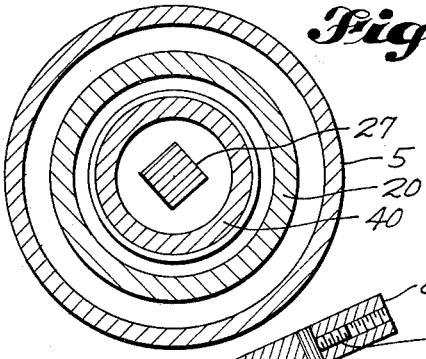
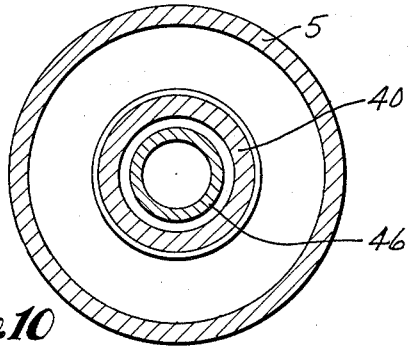
Fig. 10
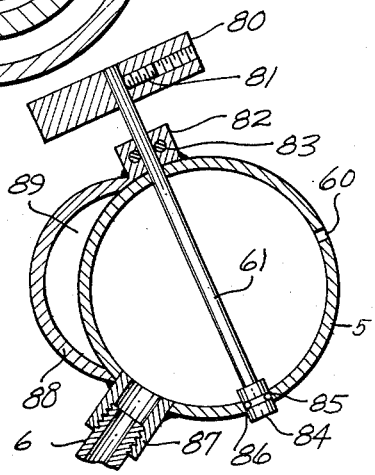
Fig. 11

COATING APPLICATOR

This invention relates to an improved applicator for coatings or adhesives. More particularly, it relates to a manifold-type applicator designed to apply parallel lines or ribbons of a fluid material to a relatively moving receiving surface. The manifold is adjustable to accomodate various widths of the material being coated without spreading the coating beyond the limits defined by the edges of the material. A purge system removes residual coating material from manifold orifices not in use in order to prevent plugging.

BACKGROUND OF THE INVENTION

Applying coatings or adhesives to various widths of sheet materials moving at high speeds has been a perennial problem in the paper industry. The effective face width of some types of coaters can be controlled with dams or similar means. In other types, size presses for example, the coating is applied to the full width of the rolls and any excess beyond the edge of the sheet is flung off or flows off of the rolls. Adhesive applicators for corrugating machines are similar to size presses in that the adhesive material covers the full width of the applicator roll. Transfer of adhesive to the edges of the lower corrugating roll is prevented by allowing the corrugated medium to balloon out slightly by centrifugal force as it passes the applicator. This causes other problems, however, such as nonuniform flutes. One approach to this problem is shown in Bruker, Canadian Pat. No. 548,505, which uses a variable width adhesive supply to the applicator roll.

New technology has recently been developed using nonaqueous adhesives, usually hot melt types, which give greater versatility in corrugated board manufacture. U.S. Pat. No. 3,518,142 to Dooley is an example. The availability of these adhesives has sparked other improvements in corrugator design, as shown in the Wolvin and Morris U.S. Pat. No. 3,972,763. This system not only captures the advantage of nonaqueous adhesives but it also is designed to overcome problems of nonuniform flutes. Wolvin et al have utilized adhesive spreaders similar to those shown in Beck et al, U.S. Pat. No. 3,688,736 and Brandenberg, U.S. Pat. No. 3,789,795. All three systems apply the adhesive as a series of parallel stripes or bands. This is advantageous for spread control with nonaqueous adhesives and particularly with hot melt systems because of their much higher viscosities than conventional starch-based adhesives. Conventional spreaders using hot melts, as shown in the aforementioned Dooley patent, have not been successful because of over-spreading of these highly viscous materials. This is not tolerable for several reasons, not the least of which is the much higher cost of the hot melts. Direct extrusion of adhesive onto the flute tips, as shown in FIG. 6 of the Dooley patent, has similarly failed to give a product of acceptable quality and price.

While the first generation adhesive spreaders of the Wolvin et al patent have worked successfully, they have not been totally without problems. These relate both to uniformity of spread and to edge control, particularly at the single facer.

A second generation adhesive spreader is shown in pending application, Ser. No. 836,181, filed Sept. 23, 1977, assigned to the present assignee, which is herein incorporated by reference. Instead of pickup rolls operating in a tray of adhesive with spread being controlled by doctoring devices, this shows the use of a uniformily apertured manifold flowing adhesive onto a transfer roll. Adhesive not transferred to the tips of the flutes of the corrugated material is doctored off of the roll into a tray. From that point it is reheated, filtered and recycled through the applicator. Spread control is achieved by a variable rate pump that supplies adhesive to the manifold.

This manifold type applicator has been a significant improvement over the original adhesive applicators but it too has left some important problems unaddressed. One of these is the perennial problem of edge control. Another has been unique to the manifold system. This is a problem of occasional orifice plugging due to high-temperature-induced chemical changes in the adhesive. One proposed explanation has been that there are eddys adjacent to the manifold walls in the areas between the orifices. Adhesive viscosity may build up in these low- or no-flow areas until gels form. Periodically these may break loose and are swept into an orifice whereupon plugging occurs. The exact cause is not known for certain, however.

In an attempt to gain edge or width of spread control the use of pistons in the ends of the manifold was tried. These could be varied axially along the manifold to control the number of orifices in communication with the adhesive source. This was successful for its intended purpose but it too created a new and intolerable problem. When the effective manifold width was adjusted from a relatively wider to a relatively narrower width, the adhesive would firmly solidify in the now unused apertures at the extreme ends of the manifold. In the warm environment this adhesive would apparently oxidize to form hard plugs which frequently had to be removed mechanically when it was again desired to bond a wider sheet.

SUMMARY OF THE INVENTION

The present invention is an improved manifold for application of coatings and adhesive materials which successfully overcomes the problems present with prior art versions. Specifically it is a center-fed manifold containing a plurality of orifices or apertures which can be adjusted by means of axially variable pistons to any desired spread width up to the full effective width of the manifold. Further, it has a purging system behind the pistons that effectively removes any residual adhesive remaining in the manifold orifices when the spread width is reduced. The purging system is designed to be effective over the full width of the manifold in order to quickly clear any orifices which might become plugged during operation with negligible downtime to operations.

It is thus an object of this invention to provide an improved manifold for application of adhesives and coatings.

It is a further object to provide a manifold easily adjustable for spread width within the limits imposed by the width of the coating or adhesive receiving surface.

It is also an object to provide an improved adhesive application system for corrugated board manufacture.

These and many other objects, features and advantages of the invention will become apparent after referring to the following description and attached drawings in which:

FIG. 1 is a partial, generalized, isometric view of the single-facer section of a corrugating machine showing the location of the applicator of the present invention.

FIG. 4 is a partial cross-sectional left-side detail of the drive assembly for positioning the control pistons to their desired operating position.

FIG. 6 is a partial cross-sectional central detail showing both control pistons near their extreme purge position at the center of the adhesive applicator manifold.

FIG. 7 is a partial cross-sectional view of the control piston drive system taken through section 7—7 of FIG. 4.

FIG. 8 is a cross-sectional view through the manifold taken through section 8—8 of FIG. 5.

FIG. 9 is a cross-sectional view through the manifold taken through section 9—9 of FIG. 5.

FIG. 10 is a cross-sectional view through the center of the manifold taken through section 10—10 of FIG. 5.

FIG. 11 is a cross-sectional view through the center of the manifold taken through section 11—11 of FIG. 6.

DESCRIPTION OF THE PREFERRED EMBODIMENTS

Figure 2:
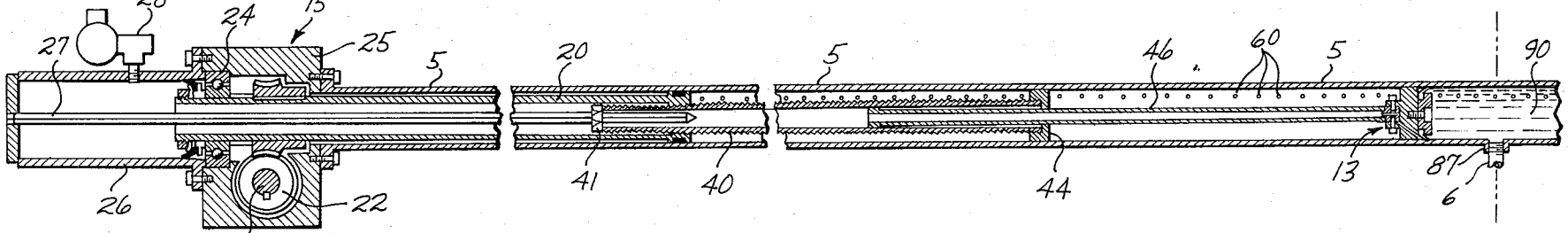
FIG. 2 is a partial cross-sectional left-side view of the applicator manifold showing the control piston near an extreme central position to purge the adhesive from the interior of the manifold.
Figure 3:
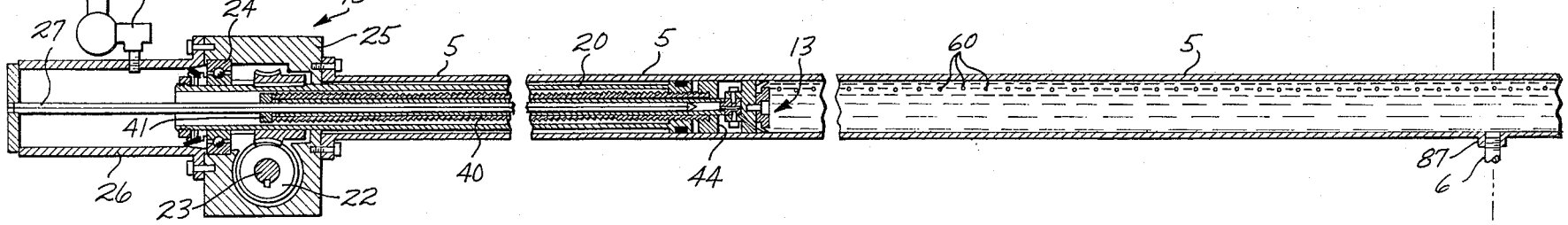
FIG. 3 is a partial cross-sectional left-side view similar to FIG. 2 but with the control piston shown at a typical operating position.
Figure 5:
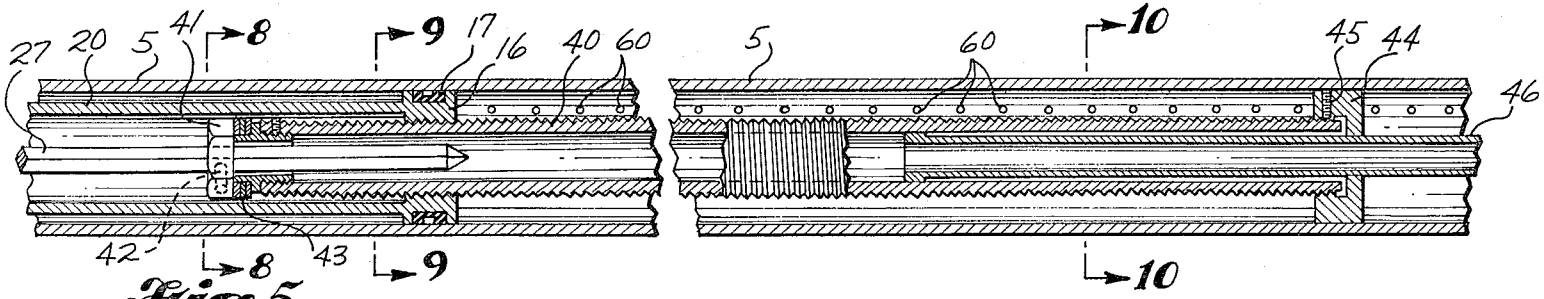
FIG. 5 is a partial cross-sectional left-side detail of the control piston operating mechanism shown in purge position.

Since the present invention is employed operationally on a corrugating machine it will be described in the context of this use. Other uses will be readily apparent to those skilled in the art.

Referring to FIG. 1, the applicator manifold is shown in place as it would be at the single facer of a typical corrugated board machine. Corrugating medium 1 passes between upper corrugating roll 2 and lower roll 3 and is corrugated at the nip between these rolls. Manifold 5 flows beads or ribbons of adhesive 7 onto applicator roll 4. The applicator roll prints them on the tips of the flute. The manifold is fed by glue supply line 6. Excess glue is doctored from applicator roll 4 by a doctor blade, not shown, and flows into pan 8, whereupon it is picked up by a pump and ultimately recirculated. The effective width of the manifold is controlled by pistons 13, 13′, whose positions are controlled by motor means 15, 15′. The corrugated sheet, now with adhesive applied, is combined with linerboard 9 at the nip between pressure roll 10 and the lower corrugating roll 3 to form a single-faced board 11.

Other arrangements are possible. As an example, the adhesive might be applied directly from manifold 5 to the corrugated medium without the use of the intermediate transfer roll. The manifold could also be used to apply coatings besides adhesives to other relatively moving materials. In the case of low viscosity coating materials, the orifices could be placed sufficiently close together to allow the individual coating streams to flow out and effectively coalesce into a continuous film on the transfer roll.

Reference is now made to FIGS. 2, 4, 5 and 6. FIG. 2 is a cross-sectional view of the manifold with the internal mechanism shown in a position in which all but a minor amount of adhesive has been flushed out. The only adhesive remaining is indicated as 90 in the central portion of the manifold. Piston assembly 13 can travel to the very center so as to completely remove essentially all of the adhesive through drain orifice 86, seen best on FIG. 11. It is shown at its present location for clarity in reading the drawings. The left-hand portion of FIG. 2 is represented in greater detail in FIG. 4. The central portion is shown in greater detail in FIG. 5. The right-hand portion of the drawing, or central part of the manifold, is shown in greater detail in FIG. 6. Referring to FIGS. 2, 3, 4 and 7, the primary drive mechanism for controlling the operating positions of the pistons will be described. Motor 70 is coupled by pin 71 to worm drive shaft 23. This is keyed to worm 22 which engages worm gear 21 which, in turn, is keyed to a tubular worm gear shaft 20. The worm drive shaft 23 is extended through gear reduction 72 and universal coupling 73, where it drives a 10-turn potentiometer 74. This can be used to give an electrical signal to a remote location to indicate the position of the piston within the manifold.

The tubular worm gear shaft 20 is supported at near proximal end in ball bearing 24. Outward of the ball bearing is spacer 34, which carries a cup seal 33. The spacer and seal are retained by washers 32, 35 and lock nut 31. The drive mechanism is retained within gear housing 25. End cover 26 is retained by bolts 38. The manifold tube itself is terminated at its proximal end in flange 36 which is secured to the gear housing by bolts 37. The end housing is supplied with a source of fluid, which may be either a liquid or gas and which is normally compressed air, through fluid supply line 30, solenoid valve 29 and fluid fitting 28. Key 27, to be referred to later, is retained in a fluid-tight relationship in the very outboard end of housing 26.

Referring to FIGS. 5, 8, 9 and 10 the tubular worm gear shaft 20 terminates in a nut 16 containing seal 17. This nut will rotate with the worm gear shaft 20 when it is driven by motor 70. Engaging the nut is an externally threaded drive tube 40. This is terminated at its proximal end by jam nut 41 fixed to the drive tube by roll pin 42. This jam nut prevents the threaded drive tube from possible overtravel during rotation of the tubular worm gear shaft. The threaded drive tube itself is prevented from rotation by key 27, which is engaged in sliding relationship with a corresponding aperture in jam nut 41. Externally threaded drive tube 40 is terminated in a bearing stop 44 which is fixed with set screw 45. This bearing stop may also carry a seal or O-ring, not shown, to provide a fluid tight seal with orifice tube 5. Piston shaft 46 is retained in sliding relationship in bearing stop 44.

Referring now to FIG. 6, we see the control piston assembly 13 at the nearly extreme central portion as indicated at the right-hand edge of FIG. 2. Normally, the width of medium run on any corrugating machine can be anticipated within given limits. It is thus not necessary to be able to control piston position toward the center of the manifold any further than is necessary to accomodate the narrowest sheet of medium that will be run on the machine. This simplifies design of the system by allowing externally threaded drive tube 40 to be much shorter than would otherwise be required for operation with extremely narrow sheets. On occasions of shut-downs, it is desirable to completely purge manifold tube 5 of any remaining adhesive. This situation is accomodated as follows in the present invention. Piston shaft 46, which terminates in control piston assembly 13, is in communication with a source of fluid pressure at its proximal end. Normally, this would be air pressure from line 30 admitted through solenoid valve 29. Under ordinary operating conditions, the pressure of the adhesive within the manifold will exert sufficient force on the distal face of piston 13 to maintain it tightly against the face of bearing stop 44. When it is desired to flush the remainder of the adhesive from the manifold, as during shutdown conditions, this can be done by opening solenoid valve 29. This pressure acts against the proximal side of piston assembly 13 to overcome the force of the adhesive against the distal face and move it to the center of the manifold. Its travel is restricted at this point by contact with piston 13' advancing from the other side. The control piston assembly itself consists of apertured plug 50, to which the actual piston 51 is attached with cap screw 52. Piston 51 terminates in cup seal 54, which is held in place by retainer 55 and a socket-head cap screw 56. Leakage past the piston is controlled not only by cup seal 54 but by piston ring 57.

A unique feature of the present invention is the provision for purging residual adhesive from the manifold orifices 60. This is accomplished as follows. Plug 50 is drilled with aperture 58 and is in communication with the source of the second or purge fluid admitted through supply line 30 and solenoid valve 29. Piston 51 is vented through aperture 59 into the gap 53 between cup seal 54 and piston 51. Aperture 59 is in communication with the fluid supply admitted through aperture 58 by virtue of a small internal space remaining between piston 51 and plug 50. Orifices 58 and 59 are of relatively small diameter so as to create a high-pressure drop when the second or purge fluid is flowing. This avoids bleeding large quantities of the second or purge fluid from behind piston assembly 13.

In operation, when it is desired to purge residual adhesive from the interior of manifold 5, the solenoid valve 29 is opened wide to admit the second or purge fluid at full pressure. This forces piston assembly 13 to the center position. Residual adhesive in the manifold can either be expelled through orifices 60 or through dump port 86, best seen in FIG. 11. The use of the dump port has the advantage in that any foreign matter within the manifold is flushed out rather than being forced into the orifices. As the piston assembly 13 advances, a small puff of the purge fluid is blown through each of the orifice openings 60 from the small reservoir of fluid contained between cup seal 54 and piston 51. This effectively blows any residual adhesive or coating material from the orifices. The dump valve comprises a plug 84 having seal ring 85, a shaft 61 and a handle 80. The shaft passes out of the manifold through shoulder 82. Leakage of interior fluid is prevented by seal ring 83. The handle 80 is secured to the shaft by set screw 81. Adhesive is also admitted to the manifold during operation at this central portion through nipple 87 and supply line 6. When hot melt adhesives are being used it is desirable to maintain a source of heat to the manifold over and above the sensible heat of the adhesive being supplied to the system. This is accomplished by partial jacket 88, which can carry a heated fluid in channel 89. Normally this would be either steam or a hot oil.

When it is desired to refill the manifold with adhesive or coating materials, the solenoid valve 29 is closed or the pressure of the purge fluid otherwise reduced. The force of the adhesive flowing into the interior of the manifold will cause piston assemblys 13, 13' to move back to their normal operating positions against the face of bearing stop 44.

This system offers great versatility and is readily adjusted to spread adhesive or coatings within the limits defined by the relatively moving receiving surface. It also overcomes the problem of the adhesive material setting up and plugging the nozzles by virtue of the purge system which flushes any residual material from the unused nozzles. If plug-ups should occur during operation, these can normally be quickly freed by admitting the flushing fluid through the solenoid valves to move the piston assemblies to the center of the manifold. This gives not only a scraping action against the interior of the manifold but supplies a fluid under greater pressure than that of the adhesive to blow foreign material from the orifices.

It should be apparent that many modifications can be made without basically changing the structure or operation of the invention. For example, piston shaft 46 could be made solid and other provisions made for admitting the flushing fluid into the annular space between cup seal 54 and piston ring 51. As another example, nut 16, terminating worm gear shaft 20, could be externally threaded. In this case the drive tube 40 would be externally, rather than internally, threaded. Many other modifications will be readily apparent to those with ordinary mechanical skill. The invention is thus not to be limited to the details disclosed within the description but is to be accorded the full scope of the claims so as to embrace any and all equivalent devices and apparatus.

We claim:

1. A fluid applicator system which is adjustable within limits defined by the edges of a relatively moving receiving surface of variable width which comprises:

(a) an apertured manifold tube;

(b) a supply of fluid to a central location of the manifold tube;

(c) a pair of opposed movable pistons within the manifold tube which act as seals at each end of the tube and define the number and position of apertures open to supply fluid to the receiving surface;

(d) drive means for controlling the location of the pistons along the axis of the manifold;

(e) the pistons also serving as purge means for expelling residual fluid from the manifold when the applicator is not in operation or to remove accumulated foreign materials having aperture-plugging tendencies.

2. The application system of claim 1 wherein the drive means comprises:

(a) motor means;

(b) a drive shaft located within the end portion of the manifold tube, coupled to the motor means at its proximal end and terminating in a threaded portion at its distal end; and (c) a threaded shaft which is restrained from rotation and which positions the piston at its distal end, the threaded shaft engaging the threaded portion of the drive shaft in a coaxial telescoping arrangement so as to be axially movable within the manifold upon rotation of the drive shaft in order to control the position of the piston.

3. The application system of claim 2 wherein the threaded shaft is located axially within a hollow drive shaft.

4. The application system of claim 3 wherein:

(a) the threaded shaft is itself hollow and terminates in a sleeve bearing at its distal end; and (b) the piston is rigidly mounted to a third shaft which is concentrically located within the threaded shaft, the third shaft being free to move back and forth within the sleeve bearing, the piston normally held in abutting relationship with the sleeve bearing by the pressure of the fluid within the manifold.

5. The application system of claim 4 including a second fluid source supplied to the outboard ends of the manifold and isolated from the first fluid by the piston, the second fluid source adapted to exert force against the proximal end of the third shaft so as to selectively force the piston inwardly toward the center of the manifold when the force exerted by the second fluid is sufficient to overcome the force exerted by the first fluid.

6. The application system of claim 5 in which the third shaft is also hollow and the force of the second fluid is exerted directly against the back of the piston.

7. The application system of claim 6 in which the piston is in two sections having an annular space between them, each section of the piston having sealing means operating against the manifold wall to prevent leakage of fluid past the section.

8. The application system of claim 7 in which the proximal section of the piston is vented to establish fluid communication between the second fluid and the annular space between the sections of the piston, so that as the piston is moved along the manifold tube the residual first fluid is flushed from the orifices by the second fluid flowing from the annular space.

9. The application system of claim 8 in which the pressure drop across the vent into the annular space between the sections of the piston is relatively high so that the force of the second fluid against the proximal section of the piston is not materially reduced.

10. The application system of claim 8 in which the second fluid is a liquid.

11. The application system of claim 8 in which the second fluid is a gas.

12. The application system of claim 11 in which the second fluid is air.

13. The application system of claim 1 further in combination with a transfer roll to transfer the first fluid from the manifold to the receiving surface.

14. The application system of claim 1 in which the receiving surface is a corrugated material.

15. The application system of claim 13 in which the receiving surface is a corrugated material.

16. The application system of claim 14 in which the first fluid is an adhesive.

17. The application system of claim 15 in which the first fluid is an adhesive.

18. The application system of claim 17 in which the adhesive is a hot melt type.

19. The application system of claim 18 in which excess adhesive is doctored from the transfer roll and recycled to the manifold.

* * * * *